US005386178A

United States Patent [19]

Son et al.

[11] Patent Number: 5,386,178

[45] Date of Patent: Jan. 31, 1995

[54] ELECTRON GUN FOR A COLOR CATHODE RAY TUBE

[75] Inventors: Wan-Jae Son; Yu-Seon Kim, both of Kyungki-do, Rep. of Korea

[73] Assignee: Samsung Electron Devices Co., Ltd., Kyungki-do, Rep. of Korea

[21] Appl. No.: 46,809

[22] Filed: Apr. 16, 1993

[30] Foreign Application Priority Data

May 19, 1992 [KR] Rep. of Korea ..... 92-8469

[51] Int. Cl.[6] ..... H01J 29/46; G09G 1/04

[52] U.S. Cl. ..... 315/15; 315/382; 313/414

[58] Field of Search ..... 315/15, 382, 14; 313/414

[56] References Cited

U.S. PATENT DOCUMENTS

| | | | |
|---|---|---|---|
| 4,814,670 | 3/1989 | Suzuki et al. | 315/15 |
| 5,025,118 | 6/1991 | Son | 313/414 |
| 5,025,189 | 6/1991 | Son | 313/414 |
| 5,034,653 | 7/1991 | Cho et al. | 313/414 |
| 5,038,073 | 8/1991 | Son | 313/414 |
| 5,142,190 | 8/1992 | Koh | 313/414 |
| 5,164,640 | 11/1992 | Son et al. | 315/382 |
| 5,291,093 | 3/1994 | Lee | 313/414 |

*Primary Examiner*—Gregory C. Issing
*Attorney, Agent, or Firm*—Leydig, Voit & Mayer

[57] ABSTRACT

An electron gun for a color cathode ray tube includes a cathode, control and screen electrodes forming a triode, 1st to 3rd focus electrodes forming a first unipotential prefocus lens, 4th and 5th focus electrodes forming a second unipotential prefocus lens with the 3rd focus electrode, a 6th focus electrode forming a bipotential prefocus lens with the 5th electrode adjacent thereto, and an accelerating electrode for forming a bipotential main focus lens with the 6th focus electrode. Vertically-elongated electron beam passing holes are respectively formed in the outgoing planes of the 1st, 3rd and 5th electrodes and horizontally-elongated electron beam passing holes are respectively formed in the incoming planes of the 3rd, 5th and 6th focus electrodes. The 2nd and 4th focus electrodes are supplied with a predetermined first static focus voltage, the 3rd and 5th focus electrodes are supplied with a second static focus voltage higher than the first static focus voltage, and the 1st and 6th focus electrodes are supplied with a dynamic focus voltage which is synchronized with a deflection signal and whose negative peak equals the second static focus voltage. The astigmatism of an electron beam spot on the periphery of the screen is improved using a dynamic quadrupole lens, thereby forming an almost circular beam spot with a small halo. Also, the focusing distance is adjusted by the dynamic variation of the intensity of a main lens, so that the spot size formed on the periphery approaches that on the center of the screen.

6 Claims, 2 Drawing Sheets

ELECTRON GUN FOR A COLOR CATHODE RAY TUBE

BACKGROUND OF THE INVENTION

The present invention relates to an electron gun for a color cathode ray tube, and more particularly to a dynamic focus electron gun capable of forming beam spots with small halos on the periphery of a screen and beam spots of regular size on both the center and periphery of the screen.

The resolution of a color cathode ray tube greatly depends on the characteristic of electron beam spots formed on a screen. To obtain an image of good quality, the electron beam spot formed on the screen should be as small as possible with the smallest halo around its core, and minimally distorted. However, in ordinary electron guns, since RGB electron guns are arranged in-line and a deflection yoke is adopted which forms a pincushion horizontal deflection magnetic field and a barrel vertical deflection magnetic field, electron beam spots formed on the periphery of the screen become distorted due to the influence of astigmatism while electron beams pass through an uneven magnetic field formed by the deflection yoke.

In other words, when electron beams land on the center of a screen, where the deflection magnetic field is weak and does not affect the beams, astigmatism of the electron beams does not occur, and a circular electron beam spot without halo is produced. However, when deflecting toward the periphery of the screen, due to a strong deflection magnetic field, the electron beams diverge in the horizontal direction and are excessively focused in the vertical direction, so that electron beam spots having a bright core and dim halo are formed on the screen.

One example of an electron gun for a conventional color cathode ray tube designed to eliminate the above-described problem is illustrated in FIG. 1.

This electron gun includes a triode portion for producing an electron beam consisting of a cathode 2, a control electrode 3 and a screen electrode 4, and a major lens system for accelerating and focusing the electron beam consisting of a static focus electrode 5 adjacent to screen electrode 4, a dynamic focus electrode 6 and a final accelerating electrode 7.

Vertically-elongated electron beam passing hole 5H and horizontally-elongated electron beam passing hole 6H are respectively formed in the electron beam passing planes of static focus electrode 5 and dynamic focus electrode 6 which face each other. Static focus electrode 5 is supplied with a predetermined static focus voltage Vf. Final accelerating electrode 7 is supplied with an anode voltage Ve being higher than focus voltage Vf. Dynamic focus electrode 6 is supplied with a dynamic focus voltage Vd which is synchronized with deflection signals and its negative peak equals focus voltage Vf.

A reference numeral 100 is a magnetic lens which represents the uneven magnetic field of the deflection yoke by means of an optical lens.

In the above-described electron gun, when the electron beam is not deflected, in other words, when the electron beam emitted from the electron gun scans the center of the screen, dynamic focus voltage Vd whose negative peak voltage equals focus voltage Vf is supplied to dynamic focus electrode 6. Therefore, a lens capable of controlling the electron beam is not formed between static and dynamic focus electrodes 5 and 6. Thus, the electron beam maintains an unaffected circular shape when passing static and dynamic focus electrodes 5 and 6, and a nearly circular beam spot is formed on the screen.

Meanwhile, when the electron beams emitted from cathode 2 scans the periphery of the screen, dynamic focus voltage Vd being higher than static focus voltage Vf supplied to static focus electrode 5 is applied to dynamic focus electrode 6, so that an electron lens, particularly a quadrupole lens, is formed between focus electrode 5 and dynamic focus electrode 6. This quadrupole lens is composed of a first lens element which has a diverging force in the vertical direction and a second lens element which has a focusing force in the horizontal direction, due to the vertically-elongated electron beam passing hole 5H formed in the outgoing plane of static focus electrode 5 and the horizontally-elongated electron beam passing hole 6H formed in the incoming plane of dynamic focus electrode 6. Accordingly, the electron beam diverges in the vertical direction and focuses in the horizontal direction while passing through quadrupole lens, thereby being vertically elongated. Then, the narrow width in the horizontal direction of the vertically elongated electron beam is compensated while passing through the uneven magnetic field of the deflection yoke which has a focusing force in the vertical direction and a diverging force in the horizontal direction, so that a circular beam spot can be obtained on the screen.

In the conventional dynamic focus electron gun, since an accelerated electron beam is controlled by the internal major lens, an extremely high dynamic focus voltage Vd must be supplied to control the already accelerated electron beam. However, it is difficult to realize a driving circuit for supplying voltages to each electrode of the electrode. Moreover, the withstand voltage characteristic of the electron gun is deteriorated.

Furthermore, in the electron gun, although occurrence of a halo at the periphery on the screen can be suppressed by the quadrupole lens, a compensation effect on the cross-sectional shape of the electron beam caused by the deflection magnetic field of the deflection yoke is incomplete. For this reason, distortion of the electron beam spot cannot be sufficiently compensated, and a moiré effect occurs on the screen.

SUMMARY OF THE INVENTION

The present invention is designed to solve the above-described problems. Accordingly, it is an object of the present invention to provide an electron gun for a color cathode ray tube capable of effectively compensating distortion of electron beam spots landing on the periphery of a screen, and forming electron beam spots of regular size throughout the screen.

It is another object of the present invention to provide an electron gun for a color cathode ray tube capable of greatly lowering a modulation voltage for changing the cross-sectional shape of an electron beam.

To achieve the above objects of the present invention, there is provided an electron gun for a color cathode ray tube comprising: a cathode, control and screen electrodes forming a triode portion; first, second and third focus electrodes forming a first unipotential prefocus lens; fourth and fifth focus electrodes forming a second unipotential prefocus lens together with the third focus electrode; a sixth focus electrode forming a bipotential prefocus lens together with the fifth electrode adjacent thereto; and an accelerating electrode for forming a bipotential main focus lens together with the sixth focus electrode, wherein vertically-elongated electron beam passing holes are respectively formed in the outgoing planes of the first, third and fifth focus electrodes;

horizontally-elongated electron beam passing holes are respectively formed in the incoming planes of the third, fifth and sixth focus electrodes;

the second and fourth focus electrodes are supplied with a predetermined static first focus voltage;

the third and fifth focus electrodes are supplied with a second focus voltage which is higher than the static first focus voltage; and the first and sixth focus electrodes are supplied with a dynamic focus voltage which is synchronized with a deflection signal and whose negative peak equals the second focus voltage.

BRIEF DESCRIPTION OF THE DRAWINGS

These and other objects, features, aspects and advantages of the present invention will become more apparent from the following detailed description of the present invention when taken in conjunction with the accompanying drawings, in which.

DETAILED DESCRIPTION OF THE INVENTION

Figure 1:
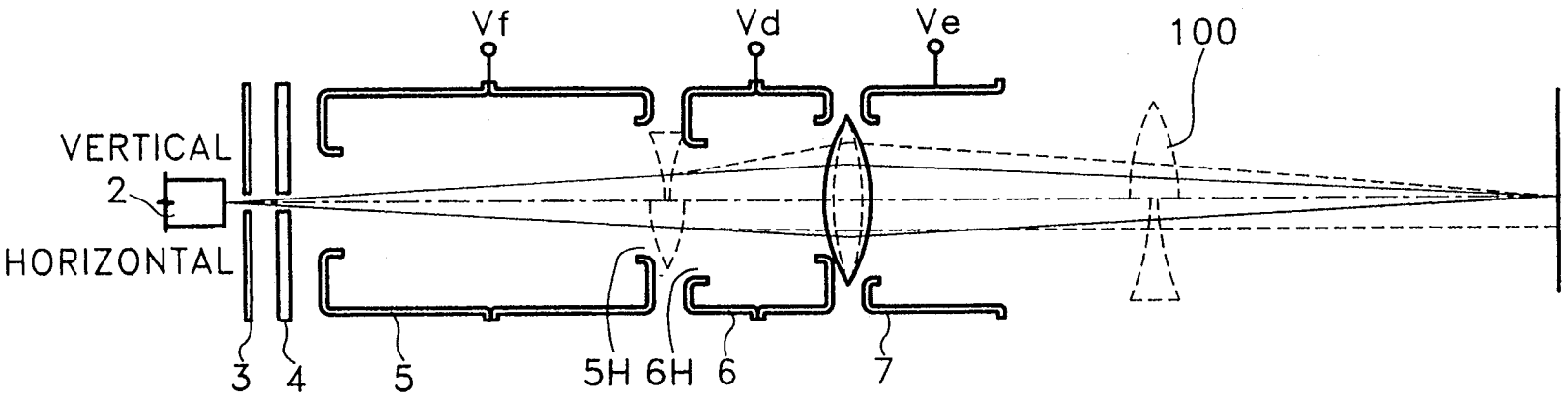
FIG. 1 (PRIOR ART)
FIG. 1 is a perspective view of a conventional electron gun for a color cathode ray tube.
Figure 2:
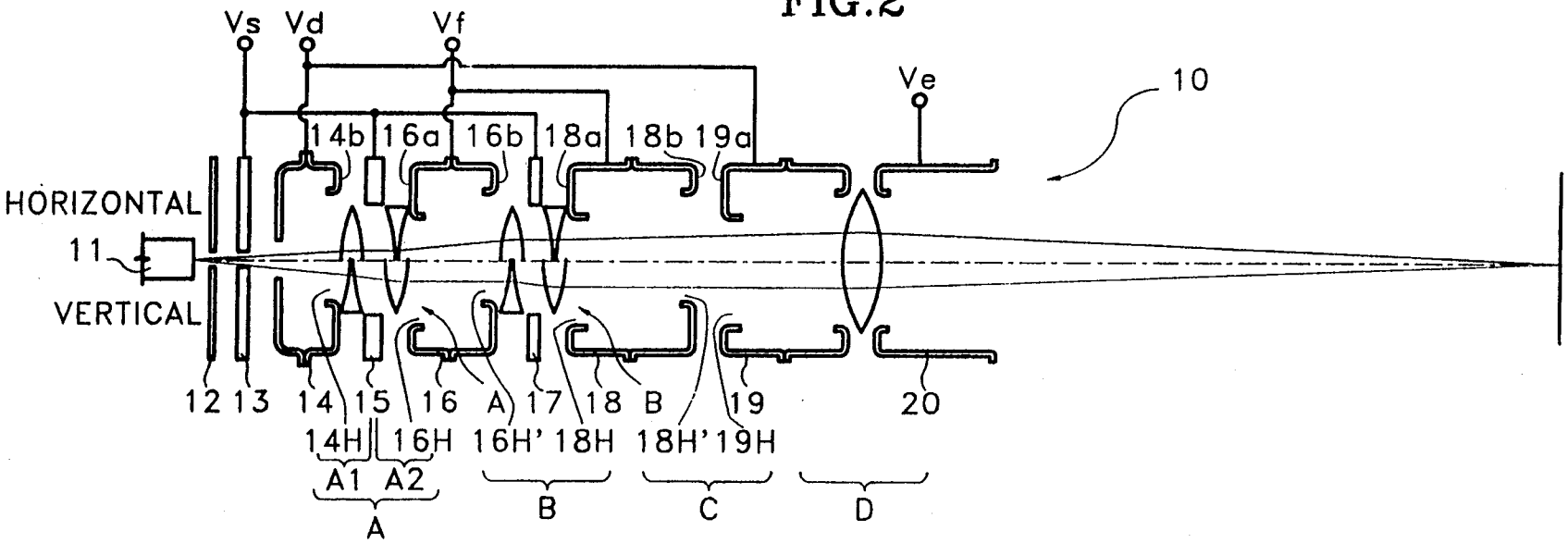
FIG. 2 is a sectional view of an electron gun for a color cathode ray tube according to the present invention showing the controlled electron beam state when scanning the center of the screen.

Referring to FIG. 2, an electron gun for a color cathode ray tube 10 according to the present invention which includes a triode portion for producing an electron beam and a major lens system. The triode portion consists of a cathode 11, a control electrode 12 and a screen electrode 13, and major lens system consists of a plurality of electrodes 14–20 which form first and second unipotential prefocus lenses A and B, a bipotential prefocus lens C and a bipotential main focus lens D. First unipotential prefocus lens A is formed by first, second and third electrodes 14, 15 and 16. Second unipotential prefocus lens B is formed between third, fourth and fifth electrodes 16, 17 and 18. Bipotential prefocus lens C is formed between fifth and sixth focus electrodes 18 and 19. Bipotential main focus lens D is formed between sixth focus and accelerating electrodes 19 and 20.

Among these focus electrodes, since the second and fourth focus electrodes thereafter form the unipotential prefocus lens together with their respectively preceding and succeeding electrodes, each is formed of a united plate-type member. Since the remaining focus electrodes 14, 16, 17, 18 and 19 form different lenses from those of adjacent electrodes, they are formed of two cup-shaped members each having an electron beam passing hole.

Figure 3:
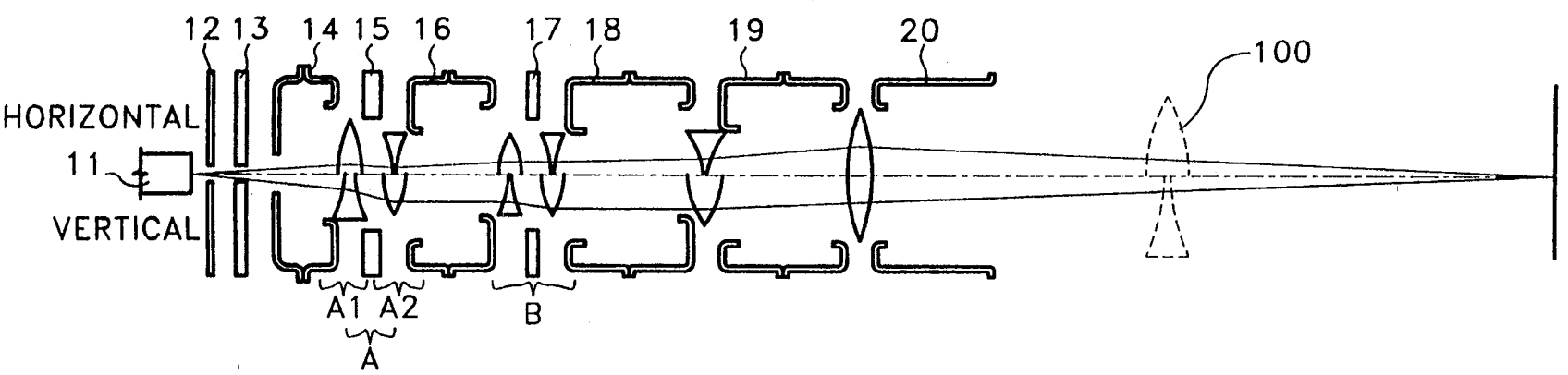
FIG. 3 is a sectional view of the electron gun for the color cathode ray tube according to the present invention showing the controlled electron beam state when scanning the periphery of the screen.

In more detail, a vertically-elongated electron beam passing hole 14H is formed on the outgoing plane **14*b* of first focus electrode 14, and a horizontally-elongated electron beam passing hole 16H is formed in the incoming plane 16*a* of third focus electrode 16, wherein first focus electrode 14 and third focus electrode 16 together form first unipotential prefocus lens A. A vertically elongated electron beam passing hole 16H' is formed in the outgoing plane 16*b* of third focus electrode 16, and a horizontally-elongated electron beam passing hole 18H is formed in incoming plane 18*a* of fifth focus electrode 18, wherein third and fifth focus electrodes 16 and 18 together form second unipotential prefocus lens B. By this construction, first and second unipotential focus lenses A and B have tile properties of a quadrupole lens which expands the electron beam in the vertical direction. Oil the other hand a vertically-elongated electron beam passing hole 18H' is formed in tile outgoing plane 18*b* of fifth focus electrode 18, and a horizontally-elongated electron beam passing hole 19H is formed in the incoming plane 19*a* of sixth focus electrode 19, wherein fifth and sixth focus electrodes 18 and 19 together form bipotential focus lens C. Thus, the bipotential prefocus lens also has properties of a quadrupole lens which expands the electron beam in the horizontal direction. In tile above description, formation of the quadrupole lens is determined by the presence of voltages supplied to the focus electrodes and their potential difference. The quadrupole lens, provides a focusing force in the horizontal direction and a diverging force in the vertical direction of the passing electron beam, thereby vertically elongating the electron beam. In the drawing of FIG. 3, a reference numeral 100** is a magnetic lens which equivalently represents an uneven magnetic field of the deflection yoke as an optical lens.

To obtain the desired lenses in the electron gun formed as above, a predetermined first static focus voltage Vs is supplied to second and fourth focus electrodes 15 and 17. A second static focus voltage Vf being higher than first static focus voltage Vs is supplied to third and fifth focus electrodes 16 and 18. A dynamic focus voltage Vd which is synchronized with a deflection signal is supplied to first and sixth focus electrodes 14 and 19. As illustrated in FIG. 2, first static focus voltage Vs is commonly supplied to screen electrode 13 which is the final electrode of the triode portion, but according to the circumstances, can be independently supplied through a separate circuit. In addition, a static anode voltage Ve which is the highest among the focus voltages is supplied to accelerating electrode 20.

In the described embodiment, first static focus voltage $V_s$ is in the range of 100 v to 300 v. Static anode voltage $V_c$ is in the range of 20 kv to 35 kv. Second static focus voltage $V_f$ is in the range of 20% to 35% of anode voltage $V_c$. The value of the voltage $V_d$ depends on the scanning position of the electron beam to be discussed below.

The operation of the electron gun for a color cathode ray tube formed as above will be described below.

To begin with, when voltages are supplied to each electrode forming electron gun 10 in the above-described pattern, as illustrated in FIG. 2, first unipotential prefocus lens A having a characteristic of a first quadrupole lens is formed between first, second and third focus electrodes 14, 15 and 16. Also, second unipotential prefocus lens B having a characteristic of a second quadrupole lens is formed between third, fourth and fifth focus electrodes 16, 17 and 18. Then, bipotential prefocus lens C having a characteristic of a third quadrupole lens is formed between fifth and sixth focus electrodes 18 and 19. Finally, bipotential main focus lens D is formed between sixth focus electrode 19 and final accelerating electrode 20. Because first and sixth focus electrodes 14 and 19 are supplied with dynamic focus voltage Vd, the intensities of first unipotential prefocus lens A and dynamic prefocus lens C formed by these electrodes vary dynamically. Especially, first prefocus lens A is composed of focusing/decelerating section A1 and diverging/accelerating section A2, and the intensity of the lens in focusing/decelerating section A 1 varies in accordance with dynamic focus voltage Vd.

Hereinbelow, controlled states of the electron beam while passing through each lens will be separately described with respect to scanning the center and the periphery of the screen. The operation when scanning tile center of the screen will be described, for convenience, assuming that tile electron beam lands on the midpoint of the screen. When scanning the center of the screen, the dynamic focus voltage $V_d$ is equal to $V_f \pm 800\ V_{p\text{-}p}$. When scanning the periphery of the screen, the dynamic focus voltage is equal to $V_f \pm 2000\ V_{p\text{-}p}$.

First, when the electron beam scans tile center of the screen and the dynamic focus voltage is the equipotential with the second Vf static focus voltage, as shown in FIG. 2, a lens is not formed between fifth and sixth focus electrodes 18 and 19, and the intensity of the dynamic first unipotential prefocus lens is weak. Accordingly, the electron beam vertically expands being subjected to a diverging force in the vertical direction and a focusing force in the horizontal direction while passing through sections A1 and A2 of the first unipotential prefocus lens, and successively expands (or is compensated), being closer to the horizontal width than to the vertical width while passing through the static second unipotential prefocus lens, so that its cross-section becomes almost circular. The electron beam controlled as above passes through the fifth and sixth focus electrodes unaffected, and then is finally accelerated while passing through bipotential main focus lens D formed by final accelerating electrode 20, thereby focusing on the center to form an almost circular spot.

Meanwhile, as illustrated in FIG. 3, when scanning the periphery of the screen, first and sixth focus electrodes 14 and 19 are supplied with dynamic focus voltage Vd being higher than static focus voltage Vf, so that the intensity of section A1 of first unipotential prefocus lens A formed between first and second focus electrodes 14 and 15 is heightened, and bipotential prefocus lens C having the property of a quadrupole lens is formed between fifth and sixth focus electrodes 18 and 19 due to their potential difference. Therefore, the electron beam produced from the triode portion is decelerated in section A1, and at the same time, strongly focused in the vertical direction and strongly diverged in the horizontal direction. Also, while passing through section A2, the electron beam undergoes a weak diverging force vertically and a weak focusing force horizontally. Consequently, the electron beam having passed through first unipotential prefocus lens A is greatly elongated in vertical direction, as compared with when scanning the center of the screen. This electron beam is under the influence of a relatively weak focusing and diverging forces in the vertical and horizontal directions, respectively, while passing through the second unipotential prefocus lens formed between third, fourth and fifth focus electrodes 16, 17 and 18. At this time, beam flux in the vertical direction of the electron beam passes near the center of the lens, and the beam flux in the horizontal direction passes the periphery of the lens, thereby being affected by a great focusing force in the horizontal direction. Subsequently, the electron beam passes through bipotential prefocus lens C formed between fifth and sixth focus electrodes 18 and 19. Since vertically-elongated electron beam passing hole 18H' and horizontally-elongated electron beam passing hole 19H are respectively formed in outgoing plane **18*b* of fifth focus electrode 18 and incoming plane 19*a* of sixth focus electrode 19 which form the bipotential prefocus lens, the electron beam passing through the peripheral portion of the bipotential prefocus lens is subjected to a strong focusing force in the horizontal direction and a strong diverging force in the vertical direction. Also, since the beam flux experiences a weak effective diverging force from the bipotential prefocus lens, the incident angle of the electron beam to the main lens narrows while passing through tile main lens formed between sixth focus electrode 19 and final accelerating electrode 20, so that the beam flux in the vertical direction is affected by a small focusing force in the main lens, which increases the focusing distance from tile screen. In addition, although the beam flux in the horizontal direction, which passes through the main focus lens has been subjected to the strong focusing force while passing through the bipotential prefocus lens, it undergoes a strong and great focusing force due to passing through the peripheral portion of the main lens after undergoing a strong diverging force in section A1 of the first unipotential lens. Therefore, the focusing distance of the beam flux of the electron beam in the horizontal direction shortens relative to that in the vertical direction, and thus, the cross-sectional shape of the electron beam having passed through the main focus lens is vertically-elongated. The electron beam vertically-elongated as described above is under the influence of a diverging force in the horizontal direction and a focusing force in the vertical direction while passing through the magnetic lens (uneven deflection magnetic field: 100**) due to the deflection yoke, thereby forming an almost circular spot on the periphery of the screen.

As described above, in the electron gun for a color cathode ray tube according to the present invention, the electron beam can be focused in multiple steps in accordance with the supply of dynamic focus voltage, so that lens astigmatism of the electron beam can be reduced. Furthermore, beam spots of even size can be formed on the phosphor screen throughout the screen by applying a varying focusing force to the electron beams which scan the periphery and center of the screen.

While the present invention has been particularly shown and described with reference to particular embodiments thereof, it will be understood by those skilled in the art that various changes in form and details may be effected therein without departing from the spirit and scope of the invention as defined by the appended claims.

What is claimed is:

1. An electron gun for a color cathode ray tube comprising:

a triode including a cathode, a control electrode and a screen electrode;

first, second and third focus electrodes forming a first unipotential prefocus lens;

fourth and fifth focus electrodes forming a second unipotential prefocus lens together with said third focus electrode;

a sixth focus electrode forming a bipotential prefocus lens together with said fifth electrode; and an accelerating electrode for forming a bipotential main focus lens together with said sixth focus electrode, wherein vertically-elongated electron beam passing holes are respectively formed in outgoing planes of said first, third and fifth electrodes and horizontally-elongated electron beam passing holes are respectively formed in incoming planes of said third, fifth and sixth focus electrodes, said second and fourth focus electrodes being supplied with a predetermined first static focus voltage and said third and fifth focus electrodes being supplied with a second focus voltage which is higher than the first static focus voltage, and said first and sixth focus electrodes being supplied with a dynamic focus voltage which is synchronized with a deflection signal and which includes a negative peak that is equal to said second focus voltage.

2. An electron gun for a color cathode ray tube comprising:

a cathode;

a control electrode adjacent to and spaced from said cathode;

a screen electrode adjacent to and spaced from said control electrode, said cathode, said screen electrode and said control electrode comprising a triode which generates an electron beam;

first, second, third, fourth, fifth and sixth electrodes arranged sequentially adjacent to the triode;

a final accelerating electrode adjacent to and spaced from said sixth electrode for accelerating and focusing the electron beam;

means for supplying a static anode voltage to said accelerating electrode;

means for supplying a first static focus voltage to said second and fourth electrodes;

means for supplying a second static focus voltage to said third and fifth focus electrodes; and means for supplying a dynamic focus voltage to said first and sixth electrodes.

3. An electron gun for a color cathode ray tube as claimed in claim 2 wherein the dynamic focus voltage has a negative peak value equal to the value of the second static focus voltage.

4. An electron gun for a color cathode ray tube as claimed in claim 2 wherein each of said first, second, third, fourth, fifth and sixth focus electrodes includes an inlet portion and an outlet portion.

5. An electron gun for a color cathode ray tube as claimed in claim 4 wherein the outlet portions of said first, third and fifth focus electrodes each include a plurality of vertically elongated electron beam passing holes.

6. An electron gun for a color cathode ray tube as claimed in claim 4 wherein the inlet portions of said third, fifth and sixth focus electrodes each include a plurality of horizontally elongated electron beam passing holes.

* * * * *